US009539451B1

(12) United States Patent
Walker

(10) Patent No.: US 9,539,451 B1
(45) Date of Patent: Jan. 10, 2017

(54) HEAT-SENSITIVE TRIGGER FOR A FIRE SPRINKLER VALVE

(71) Applicant: Bulb Link, LLC, Salt Lake City, UT (US)

(72) Inventor: Karl Walker, St. George, UT (US)

(73) Assignee: Bulb Link, LLC, Salt Lake City, UT (US)

( * ) Notice: Subject to any disclaimer, the term of this patent is extended or adjusted under 35 U.S.C. 154(b) by 0 days.

(21) Appl. No.: 15/148,640

(22) Filed: May 6, 2016

(51) Int. Cl.

| | |
|---|---|
| ***A62C 37/12*** | (2006.01) |
| ***A62C 35/68*** | (2006.01) |
| ***B05B 1/26*** | (2006.01) |
| ***B05B 1/32*** | (2006.01) |
| ***A62C 37/14*** | (2006.01) |

(52) U.S. Cl.
CPC ..... *A62C 37/12* (2013.01); *A62C 35/68* (2013.01); *A62C 37/14* (2013.01); *B05B 1/265* (2013.01); *B05B 1/326* (2013.01)

(58) Field of Classification Search
CPC ..... A62C 2/242; A62C 2/243; A62C 37/10; A62C 37/12; A62C 37/14; A62C 37/16; A62C 37/48; A62C 37/46; Y10T 137/1624; Y10T 137/1797
USPC ..... 169/37–39, 42, 43, 56–60, DIG. 3
See application file for complete search history.

(56) References Cited

U.S. PATENT DOCUMENTS

| | | | | |
|---|---|---|---|---|
| 431,972 A | | 7/1890 | Grinnell | |
| 432,404 A | * | 7/1890 | Grinnell | A62C 37/12 137/72 |
| 439,864 A | * | 11/1890 | Clapp | A62C 37/12 169/39 |
| 1,584,719 A | * | 5/1926 | Bisson | A62C 37/12 169/39 |
| 2,129,012 A | * | 9/1938 | Lewis | A62C 37/12 169/39 |
| 4,273,195 A | | 6/1981 | Fischer et al. | |
| 4,577,544 A | | 3/1986 | Lee | |
| 4,609,047 A | | 9/1986 | Pieczykolan | |
| 4,796,710 A | | 1/1989 | Job | |
| 4,893,679 A | | 1/1990 | Martin et al. | |
| 4,930,578 A | | 6/1990 | Barnett et al. | |
| 5,159,984 A | | 11/1992 | Hattori | |
| 5,494,113 A | | 2/1996 | Polan | |
| 5,551,517 A | * | 9/1996 | Arsenault | A62C 37/12 169/26 |
| 5,622,225 A | | 4/1997 | Sundholm | |
| 5,628,367 A | | 5/1997 | Truax et al. | |
| 5,826,665 A | | 10/1998 | Truax et al. | |
| 5,829,532 A | | 11/1998 | Meyer et al. | |
| 5,967,238 A | | 10/1999 | Pepi et al. | |

(Continued)

*Primary Examiner* — Arthur O Hall
*Assistant Examiner* — Tuongminh Pham
(74) *Attorney, Agent, or Firm* — Thorpe, North & Western, LLP

(57) ABSTRACT

A fire sprinkler valve trigger has a body or capsule segmented into opposite segments joined together at a joint by a fusible material with a predetermined and selected melting temperature less than a melting temperature of the opposite segments. An exterior of the body or capsule comprises a layer added to the exterior, and comprising a preselected color corresponding to and designating the melting temperature of the fusible material. The body or capsule, including the joint and the fusible material, being exposed and visible so that the layer on the exterior of the body or capsule is exposed and visible.

17 Claims, 4 Drawing Sheets

(56) References Cited

U.S. PATENT DOCUMENTS

| | | | | |
|---|---|---|---|---|
| 6,102,127 | A | 8/2000 | Pierce | |
| 6,112,820 | A | 9/2000 | Job et al. | |
| 6,336,509 | B1 | 1/2002 | Polan et al. | |
| 6,491,110 | B2 | 12/2002 | Gil | |
| 6,585,054 | B1 | 7/2003 | Thomas et al. | |
| 6,868,917 | B2 | 3/2005 | Meyer et al. | |
| 6,918,545 | B2 | 7/2005 | Franson et al. | |
| 7,036,603 | B2 | 5/2006 | Thomas et al. | |
| 7,096,964 | B2 | 8/2006 | Dushkin et al. | |
| 7,182,143 | B2 | 2/2007 | Hall et al. | |
| 7,290,618 | B2 | 11/2007 | Thomas et al. | |
| 7,314,093 | B2 | 1/2008 | Orr | |
| 7,543,654 | B2 | 6/2009 | Koiwa | |
| 8,353,357 | B2 | 1/2013 | Thompson | |
| 8,668,023 | B2 | 3/2014 | Wilkins et al. | |
| 8,684,101 | B2 | 4/2014 | Johnson et al. | |
| 8,844,554 | B2 | 9/2014 | Kikuchi et al. | |
| 8,925,641 | B1 | 1/2015 | Fischer | |
| 8,973,672 | B2 | 3/2015 | Fraederich | |
| 8,973,673 | B2 | 3/2015 | Patterson et al. | |
| 9,114,267 | B2 | 8/2015 | VanEerden et al. | |
| 9,180,326 | B2 | 11/2015 | Van Schoor et al. | |
| 2003/0173094 | A1 * | 9/2003 | Vinson ..... | A62C 31/28<br>169/37 |
| 2007/0246233 | A1 | 10/2007 | Johnson | |
| 2014/0060858 | A1 | 3/2014 | Johnson | |

* cited by examiner

HEAT-SENSITIVE TRIGGER FOR A FIRE SPRINKLER VALVE

BACKGROUND

Field of the Invention

The present invention relates generally to fire suppression sprinklers. More particularly, the present invention relates to heat-sensitive trigger for a fire sprinkler valve or head.

Related Art

Fire sprinkler valves are used in fire suppression systems for buildings or facilities. Such fire sprinkler valves have a plug retained by a heat sensitive trigger. Prior art fire sprinkler valves use triggers that are generally of two types: 1) older mechanical linkage triggers; and 2) newer frangible bulb triggers. The older mechanical linkage triggers used an offset linkage or a spring loaded linkage held in place by an alloy that melts at a low temperature, releasing the linkage, and thus the plug. The newer frangible bulb triggers use a glass bulb filled with a liquid that expands when heated, bursting the glass bulb, and releasing the trigger. The trigger mechanism is usually held between a yoke or frame and the plug. For example, see U.S. Pat. No. 5,967,238 and U.S. Pat. No. 4,796,710. The glass bulbs, however, can sustain hair-line fractures during shipping; resulting in leakage of the liquid. In addition, the liquid in the bulb can be colored to correspond to a head rating of the bulb, i.e. the heat at which the bulb bursts, activating the sprinkler. The color in the liquid, however, can fade in UV light and cold temperatures. Thus, the fire sprinkler valves with a bulb type trigger have a limited life expectancy of 25 years and should be inspected regularly. The older style fire sprinkler valves with a linkage type trigger have a life expectancy of 50 years.

SUMMARY OF THE INVENTION

It has been recognized that it would be advantageous to develop a heat sensitive trigger for a fire sprinkler valve that can replace bulb-type triggers, that is more robust, less prone to color fading or loss of liquid, and has a rapid response time index (RTI) as good or better than bulb-type triggers, and a life expectancy of at least 50 years.

The invention provides a fire sprinkler valve trigger comprising a body with a longitudinal axis; the body being segmented into opposite segments by a cut in the body; the opposite segments being joined together defining a joint between the opposite segments; a fusible material disposed in the joint between the opposite segments and joining the opposite segments together, and defining a failure point in the body between the opposite segments; the fusible material having a melting temperature less than a melting temperature of the opposite segments; an exterior of the body comprising a layer added to the exterior of the body, the layer comprising a preselected color corresponding to and designating the melting temperature of the fusible material; and the body, including the joint and the fusible material, being exposed and visible during use so that the layer on the exterior of the body is exposed and visible during use.

In addition, the invention provides a heat-sensitive trigger configured for a fire sprinkler valve having a frame or yoke with a pipe attachment, a bore and a diverter, and with a plug engaging the bore and configured to removably block a flow of a fire suppression fluid through the bore, the trigger configured to be carried by the frame or yoke and configured to releasably maintain the plug in engagement with the bore. The trigger comprises an elongated metal body with a longitudinal axis and a length between distal retainable ends; the body being segmented into opposite rods by a cut through the body oriented at an acute angle transverse with respect to the longitudinal axis; the opposite rods being joined together defining a joint between the opposite rods; a fusible material disposed in the joint between the opposite rods and joining the opposite rods together with the opposite rods joined together solely by the fusible material; the fusible material having a melting temperature less than a melting temperature of the opposite rods; an exterior of the body comprising a layer added to the exterior of the body, the layer comprising a preselected color corresponding to and designating the melting temperature of the fusible material; and an entire length of the body, including the joint and the fusible material, being exposed and visible during use, and the layer on the exterior of the body being disposed along an entire length of the body so that the layer on the exterior of the body is exposed and visible during use.

In addition, the invention provides a fire sprinkler valve trigger comprising an enclosed metal capsule with a longitudinal axis, a hollow interior, and an elongated length between distal retainable ends; the capsule being segmented into opposite segments by a cut through the capsule oriented at an acute angle transverse with respect to the longitudinal axis; the opposite segments having opposing annular faces; the opposite segments being joined together defining a joint between the opposite segments; a fusible ring disposed in the joint between the opposing annular faces of the opposite segments and joining the opposite segments together; and the fusible ring comprising a fusible material with a melting temperature less than a melting temperature of the opposite segments.

Furthermore, the invention provides a fire sprinkler valve comprising a frame or yoke with a pipe attachment, a bore and a diverter, configured to be coupled to a pipe with the pipe attachment and receive a flow of a fire suppression fluid from the pipe and through the bore, and disperse the fire suppression fluid with the diverter; a plug engaging the bore and removably blocking the flow of the fire suppression fluid through the bore; a trigger carried by the frame or yoke and releasably maintaining the plug in engagement with the bore; the trigger being elongated and having a length defined between distal retained ends; the trigger being segmented into opposite segments by a cut in the trigger oriented at an acute angle transverse with respect to a length of the trigger; the opposite segments being joined together defining a joint between the opposite segments; a fusible material disposed in the joint between the opposite segments and joining the opposite segments together, and defining a failure point in the body between the opposite segments, with the opposite segments joined together solely by the fusible material; the fusible material having a melting temperature less than a melting temperature of the opposite segments; an exterior of the trigger comprising a layer added to the exterior of the trigger, the layer comprising a preselected color corresponding to and designating the melting temperature of the fusible material; and an entire length of the trigger between the distal retained ends, including the joint and the fusible material, being exposed and visible during use, and the layer on the exterior of the trigger being disposed along an entire length of the trigger between the distal retained ends so that the layer on the exterior of the trigger is exposed and visible during use.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1A:
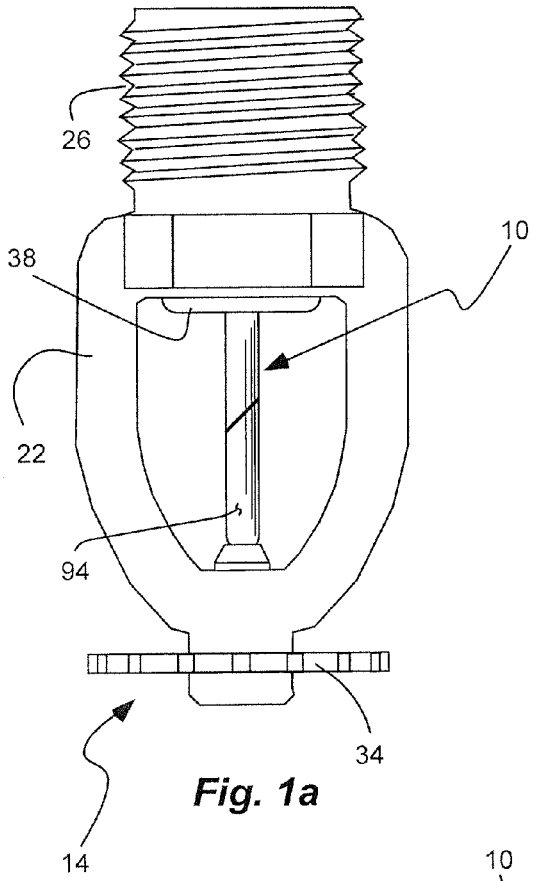
FIG. 1*a* is a side view of a fire sprinkler valve or head shown with a heat-sensitive trigger in accordance with an embodiment of the present invention, and showing that the heat-sensitive trigger is exposed and visible during use and that the heat-sensitive trigger has an exposed surface or layer with a preselected color corresponding to and designating a melting temperature of a fusible material that is also exposed and visible during use.
Figure 1B:
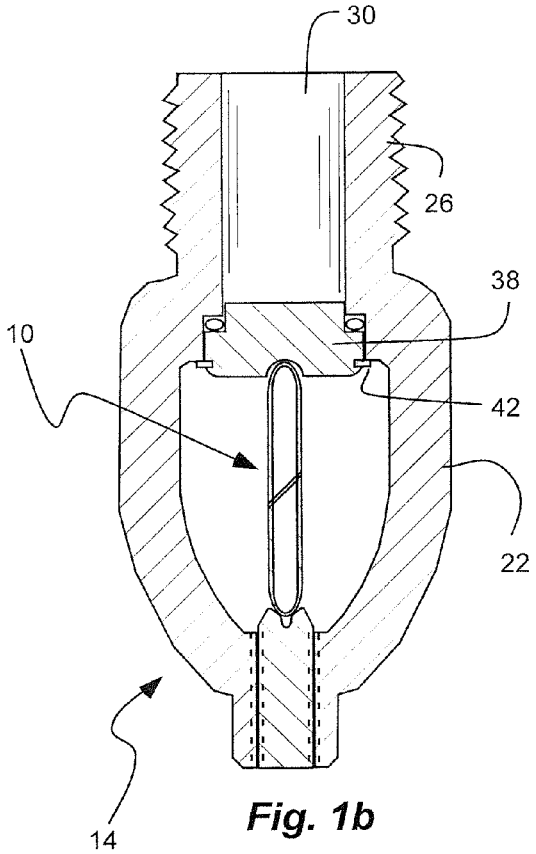
FIG. 1*b* is a cross-sectional side view of the fire sprinkler valve or head with the heat-sensitive trigger of FIG. 1*a*, taken along a vertical line or plane through a longitudinal axis of the fire sprinkler valve.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENT(S)

Description

As illustrated in FIGS. 1*a*-3, a heat-sensitive trigger, indicated generally at 10, in an example implementation in accordance with the invention is show for use with a fire sprinkler valve or head 14. The trigger 10 can resemble, and can have similar or the same physical shape and dimensions as, a glass bulb type trigger. Thus, the present trigger 10 can be used to easily replace the prior glass bulb type trigger in existing fire sprinkler valves, and/or can be used with the existing designs of fire sprinkler valves. The trigger 10, however, can be formed of metal, and without any glass, to resist inadvertent fracture of the trigger during assembly with a fire sprinkler valve, shipment, installation, and/or use. Thus, the trigger is more robust. In addition, the trigger 10 can be colored to designate a predetermined heat rating or temperature characteristic of the trigger. The heat rating of the trigger, and thus the fire sprinkler valve, can be readily identified by simple observation. The trigger can be formed without any liquid to resist discoloration or fading, and thus confusion as to the temperature rating thereof. In addition, the trigger can be configured to have a response time index (RTI) as good or better than glass bulb type triggers (e.g. of less than 50 $ms^{1/2}$). Furthermore, the trigger can be formed of a material that is not susceptible to hairline cracks.

The fire sprinkler valve or head 14 can comprise a frame or yoke 22 having a pipe attachment 26, a bore 30 through the pipe attachment, and a diverter 34 carried by the frame or yoke 22 and located opposite the bore. The pipe attachment 26, and thus the frame or yoke 22, can connect or couple to a pipe, such as with pipe threads or a threaded connection. The pipe is coupled to a source of fire suppression fluid so that the fire sprinkler valve or head can receive a flow of a fire suppression fluid from the pipe, through the bore, and disperse the fire suppression fluid with the diverter 34. The fire sprinkler valve or head 14 can be one of a plurality or network of such valves or heads in a pipe system to strategically locate the vales or heads through a building or facility. In one aspect, sprinkler system can be a wet-pipe system and the fire suppression fluid can comprise a liquid, such as water. In another aspect, the sprinkler system can be a dry-pipe system with pressurized air in the pipe prior to receiving the fire suppression fluid or water.

A plug 38 or cap is carried by the frame or yoke 22, and can engage the bore and removably block the flow of the fire suppression fluid through the bore 30. The plug 38 can be wholly or partially disposed in the bore 30. A portion of the frame or yoke (such as that carrying the diverter) can be disposed opposing and spaced-apart from the bore 30 and the plug 38. The trigger 10 is carried by the frame or yoke and disposed in the space between the plug 38 and the opposing portion of the frame or yoke. The trigger 10 releasably maintains the plug 38 in engagement with the bore 30, and thus keeps the bore closed and prevents the release of the fire suppression fluid. The trigger 10 can be held in compression between the plug 38 and the opposing portion of the frame or yoke 22. In one aspect, the compressive force F (FIG. 2*b*) can be applied by the pressure of the fire suppression fluid on the plug. In another aspect, the compressive force can be applied by a spring 42 carried by the frame or yoke. In another aspect the compressive force can be applied by the pressure of the fire suppression fluid on the plug and the spring carried by the frame or yoke.

Figure 2B:
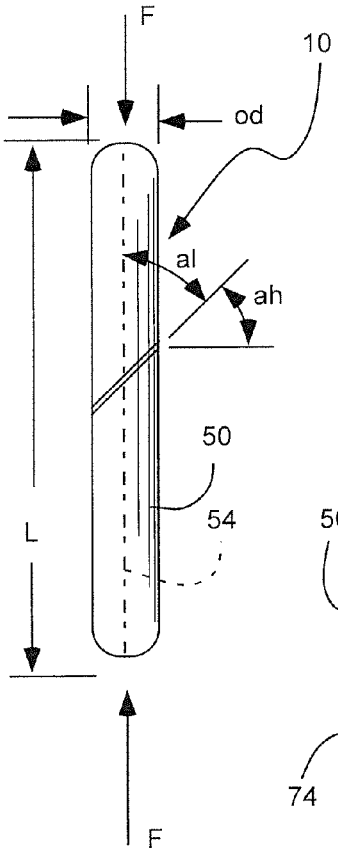
FIG. 2*b* is another side view of the heat-sensitive trigger of FIG. 1*a;*
Figure 2A:
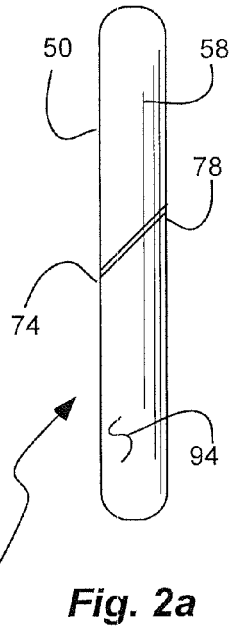
FIG. 2*a* is a side view of the heat-sensitive trigger of FIG. 1*a*, showing a metal capsule segmented into halves or segments joined by a fusible material and defining a joint between the halves or segments.
Figure 3:
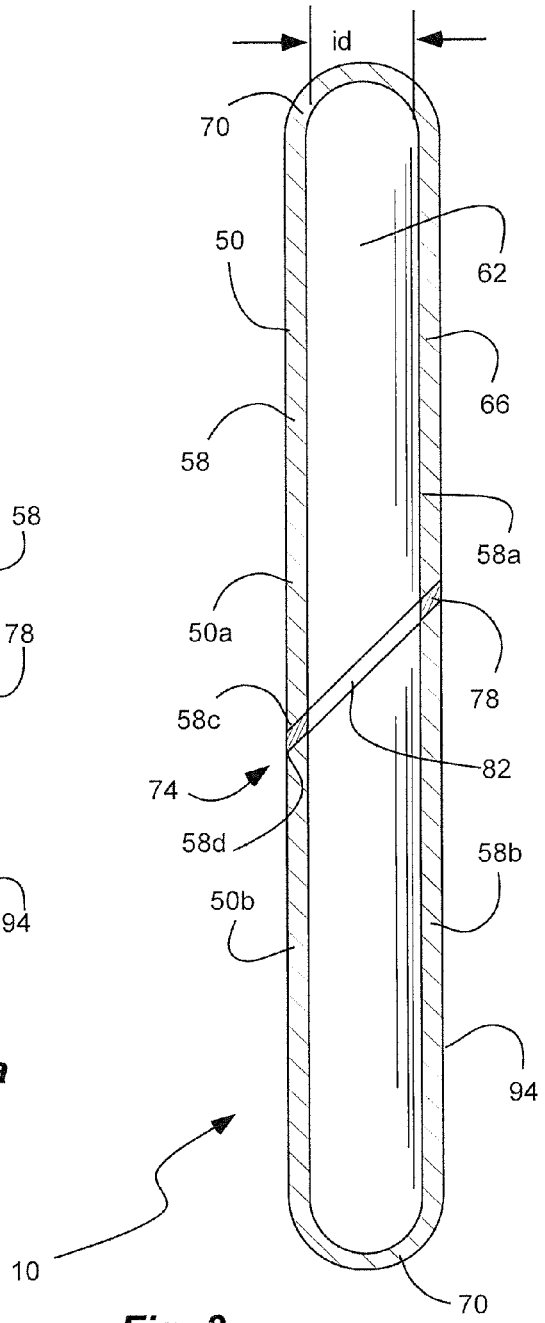
FIG. 3 is a cross-sectional side view of the heat-sensitive trigger of FIG. 1*a*, taken along a vertical line or plane through a longitudinal axis of the hear-sensitive trigger, showing the heat-sensitive trigger as a hollow, enclosed or sealed capsule void of material other than atmospheric air, and showing the joint or the fusible material as a ring.

The heat-sensitive trigger 10 for the fire sprinkler valve or head 14 can comprise an elongated metal body 50 or rod or capsule with a longitudinal axis 54. In one aspect, the trigger 10 or body 50 can be an enclosed metal capsule 58 with a hollow interior 62. The capsule 58 can be sealed, and the hollow interior 62, can be void of material (except for naturally occurring ambient air). Thus, the capsule 58 can be sealed, and the hollow interior 62, can be void of liquid or solid material (although it can contain a gas, namely ambient air). In addition, capsule 58, and/or the hollow interior 62, can be unpressurized, or have substantially the same pressure inside as ambient pressure (except for a slight pressure differential or slight vacuum or negative pressure introduced during manufacture due to heat; and/or a slight pressure differential or slight vacuum or negative pressure or even positive pressure due to different elevational pressure between point of manufacture and point of installation). The capsule 58 can have an annular cross-sectional shape taken transverse to the longitudinal axis 54. In addition, the capsule 58 can have an annular or cylindrical lateral wall 66 closed at the ends by end walls 70. The body 50 and/or capsule 58 can be sized and shaped to be used with existing designs for fire sprinkler valves or heads 14. Thus, the body 50 and/or the capsule 58 can be elongated and can have a length L (FIG. 2*b*). The ends of the body or the capsule can be retained by the fire sprinkler valve 14 (such as by the frame or yoke 22 on one end and the plug 38 on the other end), defining distal retainable ends, and with the length defined between the distal retainable ends. The body 50 and/or capsule 58 can be formed of metal, and can have a high thermal conductivity. In one aspect, the body 50 and/or capsule 58 can be formed of metal, such as aluminum, and can have a thermal conductivity of 205±20 W/mK. Thus, ambient heat will be conducted readily through the body or capsule. The capsule 58 can be formed by machining, casting, or extruding a tube and pinching and heating the ends to form an enclosure.

The body 50 and/or capsule 58 can be segmented into opposite segments 50*a* and 50*b* or 58*a* and 58*b* by a cut or seam in the body or the capsule. In one aspect, the body or capsule can be formed, and then segmented or cut. In another aspect, the opposite segments can be separately formed and then joined together to define the cut or segments. The opposite segments can be joined together defining a joint 74 or seam between the opposite segments. The segments can be fixedly or rigidly joined together at the joint. In one aspect, the cut and/or the joint 74 can extend entirely through the body or capsule (as shown in FIGS. 2*a*-8 and 19). Thus, the segments can separate by slipping with respect to one another. In another aspect, the cut and/or the joint 74 can extend substantially through the body or capsule, or mostly or through a majority of the body or capsule, but not entirely through the body or capsule leaving a narrow neck or connection between the segments (as shown in FIG. 9). Thus, the segments can separate by pivoting or bending with respect to one another. In one aspect, the cut can be oriented at an acute angle transverse with respect to the longitudinal axis 54. Thus, the angle can facilitate sliding of the segments with respect to one another during separation.

Figure 11A:
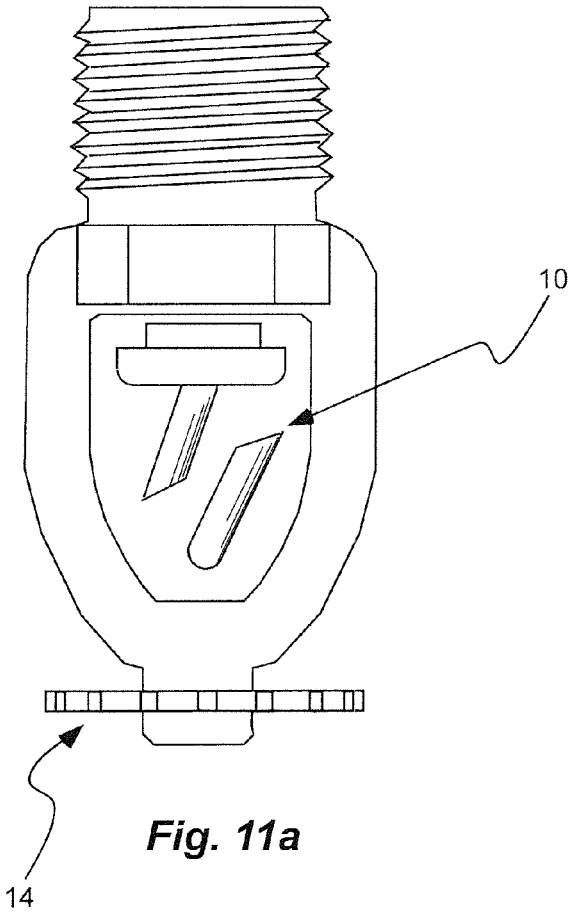
FIG. 11*a* is a side view of the fire sprinkler valve or head of FIG. 1*a* shown with the joint and the fusible material of the heat-sensitive trigger at a predetermined melting temperature allowing the segments to separate, and allowing the plug to unseat and disperse the fire suppression fluid.
Figure 11B:
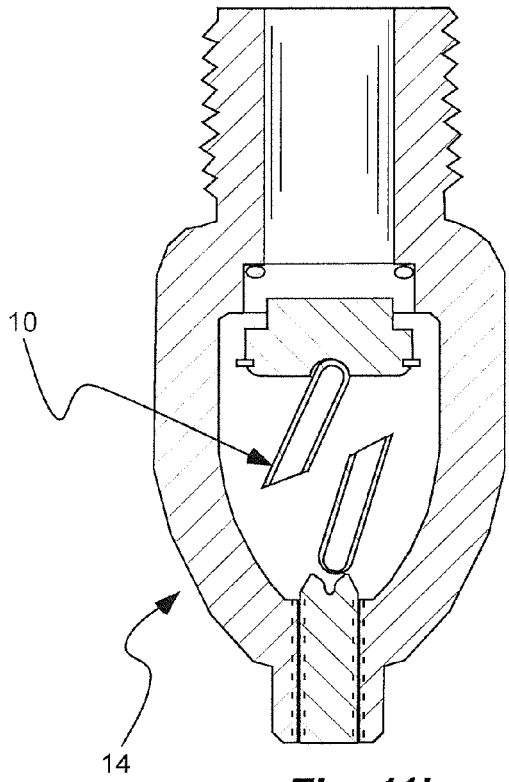
FIG. 11*b* is a cross-sectional side view of the fire sprinkler valve or head of FIG. 1*a* shown with the joint and the fusible material of the heat-sensitive trigger at a predetermined melting temperature allowing the segments to separate, and allowing the plug to unseat and disperse the fire suppression fluid.

A fusible material 78 can be disposed in the joint 74 between the opposite segments, and joining the opposite segments together. The fusible material can be heated to melt the fusible material between the opposite segments to join the opposite segments, such as by soldering. As described above, the capsule can have an annular cross-sectional shape taken transverse to the longitudinal axis. Thus, the opposite segments can have opposing annular faces 58*c* and 58*d* contacting the fusible material 78. The fusible material 78 can form a ring 82 disposed between the opposing annular faces 58*c* and 58*d*. In one aspect, the opposite segments can be joined together solely by the fusible material 78, without any exterior support structure (so that the body or capsule is exposed, as described below). The fusible material 78 and the joint 74 and the ring 82 can define a failure point in the body or capsule between the opposite segments, and about which the segments can separate when the fusible material is heated. The fusible material 78 can have a melting temperature less than a melting temperature of the opposite segments of the body or capsule. The fusible material can be selected and/or design to melt at a desires ambient temperature associated with a fire in the building or facility. The ambient temperature can be readily conducted through the metal body or capsule, or segments thereof, to the joint and the fusible material 78; which melts upon reaching a predetermined melting temperature; allowing the segments to separate; thus allowing the plug to unseat and disperse the fire suppression fluid, as shown in FIGS. 11*a* and 11*b*.

The annular cross-sectional shape of the capsule 58 can allow an exterior surface area of the capsule to be maximized to facilitate or accelerate heating of the capsule by the ambient air. In addition, the annular cross-sectional shape of the capsule 58 can concentrate the fusible material 78 in the ring 82 at the outer surface of the capsule to facilitate or accelerate melting of the fusible material or ring. The thickness of the annular wall 66, and/or the inner diameter id or width of the hollow interior 62, can be designed to tailor the surface area of the opposing annular faces 58*c* and 58*d*, and/or the surface area of the fusible material 78 or ring 82. In one aspect, a surface area of one of the opposite segments or opposing annular faces 58*c* and 58*d* is less than 0.01 square inches. In another aspect, the body or capsule can have a width or diameter od (FIG. 2*b*) at the joint 74 of less than 0.1875 inches. The body or capsule, and thus the trigger 10, can be designed to have a rapid response time index (RTI). In one aspect, the body or capsule can be designed to have a rapid response time index (RTI) of less than 50 $ms^{1/2}$. Thus, the body or capsule can have a mass less than 0.92 grams; and a diameter od less than 0.1875 inches, and a volume less than 0.02 cubic inches (0.34 cubic centimeters) of material creating the capsule. The body or capsule can have a length L between 0.375 to 0.87 inches. In one aspect, the fusible material 78 and the joint 74 and the ring 82 can be oriented at an angle a1 between 45 to 60 degrees with respect to the longitudinal axis (or an angle ah between 30 to 45 degrees with respect to horizontal when the body or the capsule is oriented vertically). The fusible material 78 and the joint 74 and the ring 82 can be oriented at an angle ah between 30 to 55 degrees in one aspect, 35 to 50 degrees in another aspect, or 40-55 degrees in another aspect, with respect to horizontal when the body or the capsule is oriented vertically. The greater angle with respect to the longitudinal axis (or lesser the angle with respect to horizontal when the capsule is oriented vertically) can reduce shear tension in the fusible material and/or joint. In another aspect, the body 50 or the capsule 58 can have an exterior with a circular cross sectional shape to maximize exposed surface area to ambient temperature, and to minimize internal surface area contacting the fusible material.

As described above, the trigger 10 can also have an exterior of the body 50 or the capsule 58, and the joint 74 and the fusible material 78 or the ring 82, that is exposed and visible during use, or when installed in the fire sprinkler valve or head 14. Thus, the entire length L of the body 50 or the capsule 58 between the distal retained ends can be exposed (i.e. the portion between the distal retained ends is exposed while the distal retained ends themselves may be covered by the frame or yoke 22 on one end and the plug 38 on the other end). As described above, the opposite segments can be joined together solely by the fusible material 78, free of any exterior support structure, so that the body or the capsule is exposed and visible. Having a visible trigger (the body or the capsule and the fusible material 78 and the joint 74) allows the trigger to be visually inspected without disassembly or removal. In one aspect, the body or the capsule can be cylindrical so that an entire exterior surface faces radially outwardly. In addition, the opposite segments can be joined together solely by the fusible material, and unrestrained or unrestricted by any exterior structure, so that the body or capsule has a free slip plane, defined by the joint 74.

The exterior of the body 50 or the capsule 58 comprises a layer 94 added to the exterior of the body or the capsule. The layer 94 comprises a preselected color corresponding to and designating a predetermined and selected melting temperature of the fusible material 78. As described above, the body or the capsule, including the joint and the fusible material, is exposed and visible during use. Thus, the layer 94 on the exterior of the body or capsule is exposed and visible during use, or when installed in the fire sprinkler valve or head 14. Having the layer 94 visible, and thus the color and the corresponding melting temperature of the joint and the fusible material, allows the heat rating of the trigger and the fire sprinkler valve to be immediately identified. In one aspect, the layer 94 can be formed on a portion of the body or the capsule. A length of the body or the capsule can be exposed along at least 50% of the length, defining an exposed length. The layer 94 on the exterior of the body or the capsule can be disposed along an entire length of the exposed length. In another aspect, the layer 94 can be formed on the entire body or the entire capsule (or visible portion thereof when installed on the fire sprinkler valve). The layer 94 on the exterior of the body or the capsule can be disposed along an entire length L of the body or the capsule between the distal retainable ends. In one aspect, the layer can be integral with the material, such as by anodizing forming an anodized layer. In another aspect, the layer can be a separate and discrete layer covering the exterior of the body or the capsule, such as paint or dye. In one aspect, the layer 94 on the exterior of the body or the capsule can be disposed immediately adjacent to the joint 74 and immediately adjacent to the fusible material 78 so that the temperature rating and the trigger can be simultaneously identified and inspected.

Different triggers with different fusible materials in the joints thereof can be provided in different fire sprinkler valves for different heat ratings or applications. The different triggers, or bodies or capsules thereof, can have different layers with different colors corresponding to the different melting temperatures of the fusible materials.

Figure 4:
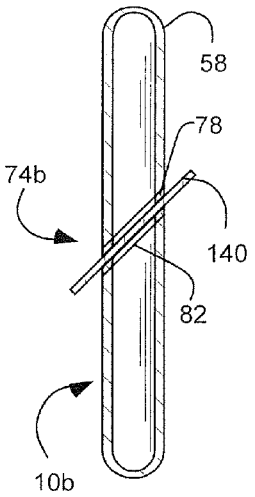
FIG. 4 is a cross-sectional side view of another heat-sensitive trigger in accordance with another embodiment of the present invention, showing a disc or plate extending through the joint of the hollow metal capsule and formed of a thermally conductive material to facilitate and/or accelerate melting of the fusible material.

Referring to FIG. 4, another heat-sensitive trigger 10*b* in accordance with another embodiment of the present invention is shown in cross-section. The trigger 10*b* is similar in many respects to that described above, and which description is applicable to the present trigger, or is hereby incorporated by reference herein. The trigger 10*b* has a disc or plate 140 extending through the joint 74*b* of the hollow metal capsule 58. The disc or plate 140 is formed of a thermally conductive material, such as aluminum, to facilitate and/or accelerate melting of the fusible material 78. The disc or plate 140 can provide greater surface area to be heated by the ambient air or temperature, and can have high thermal conductivity to transfer that heat to the joint 74*b* to melt the fusible material 78. In one aspect, the disc or plate 140 can be sandwiched between the segments, and between the fusible materials 78. Thus, the fusible material 78 can be disposed on both sides of the disc or plate 140, and there can be two rings 82, each on an opposite side of the disc or plate 140.

Figure 5:
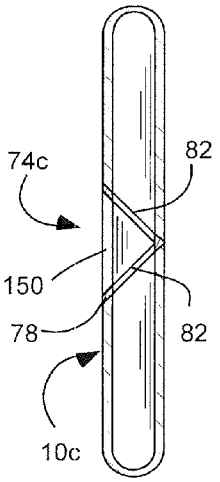
FIG. 5 is a cross-sectional side view of another heat-sensitive trigger in accordance with another embodiment of the present invention, showing a pair of joints in the hollow metal capsule oriented to form a wedge element between the halves or segments of the heat-sensitive trigger.

Referring to FIG. 5, another heat-sensitive trigger 10*c* in accordance with another embodiment of the present invention is shown in cross-section. The trigger 10*c* is similar in many respects to those described above, and which descriptions are applicable to the present trigger, or are hereby incorporated by reference herein. The trigger 10*c* has a joint 74*c*, or a pair of joints 74*c*, with a pair of cuts or seams, and a pair of rings 82, in the hollow metal capsule 58. The pair of joints or cuts are oriented to form a wedge element 150 between the halves or segments of the capsule. The pair of joints and/or the wedge element can allow the halves or segments of the capsule to pivot or bend with respect to one another as a primary movement path or failure path, rather than slide. Thus, the halves or segments can collapse towards one another as the fusible material 78 melts. In one aspect, the wedge element can form a cylinder with opposite angled ends. In another aspect, the wedge element can be open and can form an arc.

In one aspect, the capsule or bulb described above can provide an interior hollow that is void of material. The hollow interior can facilitate manufacture, and reduce failures or inconsistent operation due to leaks. In another aspect, the capsule or bulb can have a liquid, such as glycerin, therein to supplement the fracture of the joint.

In one aspect, the capsule or bulb described above can be sealed to resist fouling. In another aspect, the capsule or bulb can have openings therein, such as at the ends, or lateral apertures in the cylindrical walls, to allow ambient air and ambient temperature therein to facilitate head transfer to the fusible material in the joint.

In one aspect, the capsule or bulb described above can have straight cylindrical walls to facilitate manufacture. In another aspect, the capsule or bulb can have non-straight or non-linear walls. For example, the capsule or bulb can have bulbous ends to facilitate seating in the frame or yoke and the plug.

In one aspect, the capsule or bulb described above can provide a hollow cylinder with a greater outer diameter and a lesser mass that a solid bar of equal diameter. Thus, the hollow cylinder can provide good structural rigidity and compression strength due to its outer diameter, while also providing rapid heat transfer due to its lesser mass. In addition, the hollow cylinder can reduce the surface area of the opposing annular faces contacting the fusible material, while maintaining structural rigidity and compression strength, and reducing the response time index (RTI) of the trigger. Furthermore, the hollow cylinder can provide good visibility or the exterior layer and color thereof to facilitate visibility and identification, without compromising the response time index (RTI) of the trigger. In another aspect, the body can comprise a solid metal rod or bar. A solid metal rod or bar can facilitate manufacture, and can have good rigidity and compression strength.

Figure 6:
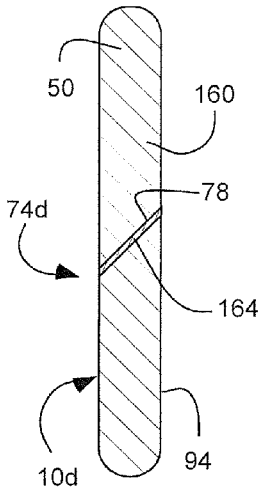
FIG. 6 is a cross-sectional side view of another heat-sensitive trigger in accordance with another embodiment of the present invention, showing the heat-sensitive trigger as a solid metal bar that is exposed and visible during use and with an exterior surface or layer with a preselected color corresponding to and designating a melting temperature of a fusible material that is also exposed and visible during use.

Referring to FIG. 6, another heat-sensitive trigger 10*d* in accordance with another embodiment of the present invention is shown in cross-section. The trigger 10*d* is similar in many respects to those described above, and which descriptions are applicable to the present trigger, or are hereby incorporated by reference herein. The trigger 10*d* has a body 50 that is a solid metal body or bar 160 that is segmented into opposite segments or opposite bars or rods jointed together at a joint 74*d* with fusible material 78. The bar 160 can be formed by extrusion and then cutting or crimping to length. The fusible material can be disposed in or formed in a disc 164. In addition, as described above, the solid body or bar is exposed and visible during use and with an exterior surface or layer 94 with a preselected color corresponding to and designating a melting temperature of a fusible material that is also exposed and visible during use.

Figure 7:
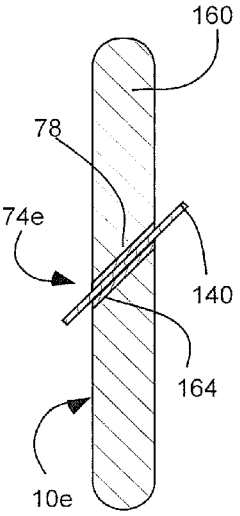
FIG. 7 is a cross-sectional side view of another heat-sensitive trigger in accordance with another embodiment of the present invention, showing a disc or plate extending through the joint of the solid metal rod and formed of a thermally conductive material to facilitate and/or accelerate melting of the fusible material.

Referring to FIG. 7, another heat-sensitive trigger 10*e* in accordance with another embodiment of the present invention is shown in cross-section. The trigger 10*e* is similar in many respects to those described above, and which descriptions are applicable to the present trigger, or are hereby incorporated by reference herein. The trigger 10*e* has a disc or plate 140 extending through the joint 74*e* of the solid metal body or rod 160 that is segmented into opposite segments or opposite bars or rods jointed together at a joint 74*e* with fusible material 78. The disc or plate 140 is formed of a thermally conductive material, such as aluminum, to facilitate and/or accelerate melting of the fusible material 78. The disc or plate 140 can provide greater surface area to be heated by the ambient air or temperature, and can have high thermal conductivity to transfer that heat to the joint 74*e* to melt the fusible material 78. In one aspect, the disc or plate 140 can be sandwiched between the segments, and between the fusible materials 78. Thus, the fusible material 78 can be disposed on both sides of the disc or plate 140, and there can be two discs 164, each on an opposite side of the disc or plate 140.

Figure 8:
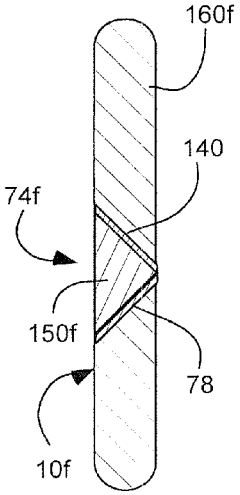
FIG. 8 is a cross-sectional side view of another heat-sensitive trigger in accordance with another embodiment of the present invention, showing a pair of joints in the solid metal bar oriented to form a wedge element between the halves or segments of the heat-sensitive trigger, and showing the joints extending entirely through the bar.
Figure 9:
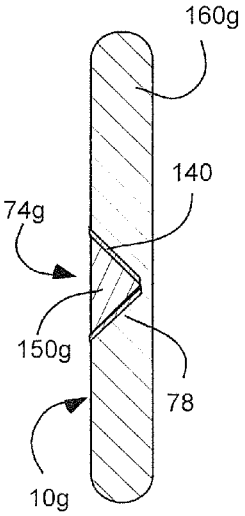
FIG. 9 is a cross-sectional side view of another heat-sensitive trigger in accordance with another embodiment of the present invention, showing a pair of joints in the solid metal bar oriented to form a wedge element between the halves or segments of the heat-sensitive trigger, and showing the joints extending a majority, but partially, through the bar.

Referring to FIGS. 8 and 9, other heat-sensitive triggers 10*f* and 10*g* in accordance with other embodiments of the present invention are shown in cross-section. The triggers 10*f* and 10*g* are similar in many respects to those described above, and which descriptions are applicable to the present triggers, or are hereby incorporated by reference herein. The triggers 10*f* and 10*g* have a joint 74*f* or 74*g*, or a pair of joints 74*f* or 74*g*, with a pair of cuts or seams, and a pair of discs or plates 140, in the solid metal bodies or rods 160*f* or 160*g*. The pair of joints or cuts are oriented to form a wedge element 150*f* or 150*g* between the halves or segments of the bodies or rods. In one aspect, the cuts or joints can extend through the body or rod 160*f*, and the wedge element 150*f* can form a bar with opposite angled ends and a diameter equal to the body or rod, as shown in FIG. 8. In another aspect, the cuts or joints can extend partially through the body or rod 160*g*, and the wedge element 150*g* can form a bar with opposite angled ends and a diameter less than the body or rod, as shown in FIG. 9. The pair of joints and/or the wedge elements can allow the halves or segments of the bodies or rods to pivot or bend with respect to one another as a primary movement path or failure path, rather than slide. Thus, the halves or segments can collapse towards one another as the fusible material 78 melts.

Figure 10:
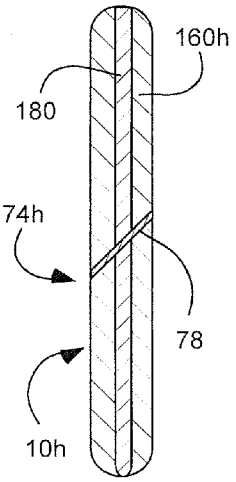
FIG. 10 is a cross-sectional side view of another heat-sensitive trigger in accordance with another embodiment of the present invention, and showing the heat-sensitive trigger as a solid metal bar with a core therein formed of a thermally conductive material to facilitate and/or accelerate melting of the fusible material.

Referring to FIG. 10, another heat-sensitive trigger 10*h* in accordance with another embodiment of the present invention is shown in cross-section. The trigger 10*h* is similar in many respects to those described above, and which descriptions are applicable to the present trigger, or are hereby incorporated by reference herein. The trigger 10*h* has a solid metal body or bar 160*h* with a core 180 therein formed of a thermally conductive material to facilitate and/or accelerate melting of the fusible material 78. The core 180 can extend along a longitudinal interior of the body to the joint 74*h*. The core 180 can include a different material than the body or rod, such as copper.

The descriptions of the different embodiments apply to each other or the other embodiments. Thus, a feature or aspect described in one embodiment is applicable to another embodiment.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A fire sprinkler valve trigger, comprising:

a) a body with a longitudinal axis, the body being an enclosed metal capsule with a hollow interior void of material and having an annular cross-sectional shape taken transverse to the longitudinal axis;

b) the body being segmented into opposite segments by a cut in the body, the opposite segments having opposing annular faces;

c) the opposite segments being joined together defining a joint between the opposite segments;

d) a fusible ring of fusible material disposed in the joint between the opposing annular faces of the opposite segments and joining the opposite segments together, and defining a failure point in the body between the opposite segments; and e) the fusible material having a melting temperature less than a melting, temperature of the opposite segments.

2. The trigger in accordance with claim 1, wherein the body is elongated and has length defined between distal retainable ends and that is exposed along at least 50% of the length, defining an exposed length; and wherein the layer on the exterior of the body is disposed along an entire length of the exposed length.

3. The trigger in accordance with claim 1, wherein the body is elongated and has length defined between distal retainable ends; and wherein an entire length of the body between the distal retained ends is exposed; and wherein the layer on the exterior of the body is disposed along an entire length of the body between the distal retainable ends.

4. The trigger in accordance with claim 1, wherein the opposite segments are joined together solely by the fusible material; and wherein the layer on the exterior of the body is disposed immediately adjacent to the joint and immediately adjacent to the fusible material.

5. The trigger in accordance with claim 1, wherein the cut extends entirely through the body; and wherein the opposite segments have opposing faces contacting the fusible material with a surface area of one of the opposite segments is less than 0.01 square inches, and the body has a width or diameter at the joint of less than 0.1875 inches.

6. The trigger in accordance with claim 1, wherein the body has a mass less than 0.92 grams.

7. The trigger in accordance with claim 1, wherein the body is formed of a metal material and has a thermal conductivity of 205±20 W/mK.

8. The trigger in accordance with claim 1, wherein the trigger has a response time index (RTI) of less than 50 $ms^{1/2}$.

9. The trigger in accordance with claim 1, in combination with the fire sprinkler valve having a frame or yoke with a pipe attachment, a bore and a diverter, and with a plug engaging the bore and configured to removably block a flow of a fire suppression fluid through the bore, the body carried by the frame or yoke and releasably maintaining the plug in engagement with the bore.

10. A heat-sensitive trigger configured for a fire sprinkler valve having a frame or yoke with a pipe attachment, a bore and a diverter, and with a plug engaging the bore and configured to removably block a flow of a fire suppression fluid through the bore, the trigger configured to be carried by the frame or yoke and configured to releasably maintain the plug in engagement with the bore, the trigger comprising:

a) an elongated metal body with a longitudinal axis and a length between distal retainable ends, the body being an enclosed metal capsule with a hollow interior void of material and having an annular cross-sectional shape taken transverse to the longitudinal axis;

b) the body being segmented into opposite rods by a cut through the body oriented at an acute angle transverse with respect to the longitudinal axis, the opposite segments having opposing annular faces;

c) the opposite rods being joined together defining a joint between the opposite rods;

d) a fusible ring of fusible material disposed in the joint between the opposing annular faces of the opposite rods and joining the opposite rods together with the opposite rods joined together solely by the fusible material;

e) the fusible material having a melting temperature less than a melting temperature of the opposite rods;

f) an exterior of the body comprising a layer added to the exterior of the body, the layer comprising a preselected color corresponding to and designating the melting temperature of the fusible material; and g) an entire length of the body, including the joint and the fusible material, being exposed and visible during use, and the layer on the exterior of the body being disposed along an entire length of the body so that the layer on the exterior of the body is exposed and visible during use.

11. A fire sprinkler valve trigger, comprising:

a) an enclosed metal capsule with a longitudinal axis, a hollow interior void of material, and an elongated length between distal retainable ends;

b) the capsule being segmented into opposite segments by a cut through the capsule oriented at an acute angle transverse with respect to the longitudinal axis;

c) the opposite segments having opposing annular faces;

d) the opposite segments being joined together defining a joint between the opposite segments;

e) a fusible ring disposed in the joint between the opposing annular faces of the opposite segments and joining the opposite segments together; and f) the fusible ring comprising a fusible material with a melting temperature less than a melting temperature of the opposite segments.

12. The trigger in accordance with claim 11, further comprising:

a) an exterior of the capsule comprising a layer added to the exterior of the capsule, the layer comprising a preselected color corresponding to and designating the melting temperature of the fusible material of the fusible ring; and b) the capsule, including the joint and the fusible ring, being exposed along the length between the distal retainable ends, and visible during use so that the layer on the exterior of the capsule is exposed and visible during use.

13. The trigger in accordance with claim 12, wherein an entire length of the capsule between the distal retained ends is exposed; and wherein the layer on the exterior of the capsule is disposed along an entire length of the capsule between the distal retained ends.

14. The trigger in accordance with claim 12, wherein the opposite segments are joined together solely by the fusible ring; and wherein the layer on the exterior of the capsule is disposed immediately adjacent to the joint and thus immediately adjacent to the fusible material.

15. The trigger in accordance with claim 11, in combination with the fire sprinkler valve having a frame or yoke with a pipe attachment, a bore and a diverter, and with a plug engaging the bore and configured to removably block a flow of a fire suppression fluid through the bore, the capsule carried by the frame or yoke and releasably maintaining the plug in engagement with the bore.

16. A fire sprinkler valve, comprising:

a) a frame or yoke with a pipe attachment, a bore and a diverter, configured to be coupled to a pipe with the pipe attachment and receive a flow of a fire suppression fluid from the pipe and through the bore, and disperse the fire suppression fluid with the diverter;

b) a plug engaging the bore and removably blocking the flow of the fire suppression fluid through the bore;

c) a trigger carried by the frame or yoke and releasably maintaining the plug in engagement with the bore, the trigger being an enclosed metal capsule with a hollow interior void of material and having an annular cross-sectional shape taken transverse to the longitudinal axis;

d) the trigger being elongated and having a length defined between distal retained ends;

e) the trigger being segmented into opposite segments by a cut in the trigger oriented at an acute angle transverse with respect to a length of the trigger, the opposite segments having opposing annular faces;

f) the opposite segments being joined together defining a joint between the opposite segments;

g) a fusible ring of fusible material disposed in the joint between the opposite segments and joining the opposing annular faces of the opposite segments together, and defining a failure point in the trigger between the opposite segments, with the opposite segments joined together solely by the fusible material;

h) the fusible material having a melting temperature less than a melting temperature of the opposite segments;

i) an exterior of the trigger comprising a layer added to the exterior of the trigger, the layer comprising a preselected color corresponding to and designating the melting temperature of the fusible material; and j) an entire length of the trigger between the distal retained ends, including the joint and the fusible material, being exposed and visible during use, and the layer on the exterior of the trigger being disposed along an entire length of the trigger between the distal retained ends so that the layer on the exterior of the trigger is exposed and visible during use.

17. The trigger in accordance with claim 1, further comprising:

an exterior of the body comprising a layer added to the exterior of the body, the layer comprising a preselected color corresponding to and designating the melting temperature of the fusible material; and the body, including the joint and the fusible material, being exposed and visible during use so that the layer on the exterior of the body is exposed and visible during use.

* * * * *